United States Patent [19]

Perlman

[11] 4,295,318

[45] Oct. 20, 1981

[54] CONNECTOR FOR WOODEN TRUSS

[75] Inventor: Milton Perlman, Miami Beach, Fla.

[73] Assignee: Monex Corporation, North Miami Beach, Fla.

[21] Appl. No.: 60,912

[22] Filed: Jul. 26, 1979

[51] Int. Cl.[3] ..... E04C 3/02

[52] U.S. Cl. ..... 52/693; 52/DIG. 6; 411/467

[58] Field of Search ..... 52/DIG. 6, 693–696; 85/13

[56] References Cited

U.S. PATENT DOCUMENTS

| | | | |
|---|---|---|---|
| 3,025,577 | 3/1962 | Jureit | 52/DIG. 6 |
| 3,416,283 | 12/1968 | Sanford | 85/13 |
| 3,591,997 | 7/1971 | Tennison et al. | 52/657 |
| 3,875,719 | 4/1975 | Menge | 52/669 |
| 4,078,352 | 3/1978 | Knowles | 52/693 |

*Primary Examiner*—James L. Ridgill, Jr.
*Attorney, Agent, or Firm*—Ronald A. Sandler

[57] ABSTRACT

There is disclosed a metal connector for diagonal interconnection between the upper and lower chords and two adjacent vertical studs of a wooden truss so as to form a tension web thereof. The connector is of unitary one-piece construction, including an elongated support member having a stiffening rib and stiffening side flanges, and being provided at the opposite ends thereof with two generally rectangular end plates. Each end plate has stamped therefrom a plurality of pairs of fastening brads or nails which are adapted to be embedded in the overlapped portions of the chords and studs to be interconnected. Indexing holes are also provided in the end plates to facilitate manufacture of the connector and locating of the connector with respect to the truss.

2 Claims, 5 Drawing Figures

10
11
12
13
14
15
15A
16
17
19
20
21
22
23
24
26
30
31
32
33
35
37
38
39
3

CONNECTOR FOR WOODEN TRUSS

BACKGROUND OF THE INVENTION

The present invention relates to structural connectors for use in wood trusses or the like. In particular, the present invention relates to diagonal connections such as tension webs for trusses.

Wooden floor trusses and flat roof trusses typically are formed of horizontal upper and lower chords interconnected by spaced-apart vertical studs. Such trusses also are commonly strengthened and stabilized by the use of diagonal tension webs positioned between adjacent studs. Whether the truss is framed on site or prefabricated, these tension webs cause considerable difficulty in fabrication and assembly, because the ends must be sawed at precise angles to fit in the angles between the horizontal and vertical members of the truss. Special web saws must be used and the process is slow and laborious.

Metal diagonal structural connectors are known in the art and are disclosed, for example, in U.S. Pat. Nos. 3,591,997 and 3,875,719, for framing side walls of buildings or tying multiple truss sections together. Such prior art connectors include metal strips which must be inserted into complementary grooves cut in the wood members. This necessitates a separate sawing operation which must be very carefully and accurately done. Furthermore, these prior art connectors are attached by separate fastening nails which must be individually hammered, which further adds to the time and cost of the assembly operation. Other metal tension webs are known in which the fastening portions are manufactured separately from the interconnecting truss web and require additional assembly operations and because of the configuration, result in substantial metal scrap in construction.

SUMMARY OF THE INVENTION

The present invention provides an improved one piece structural connector particularly suitable for forming a tension web of a truss, which avoids disadvantages of prior art connectors and affords other important operating advantages.

It is a general object of this invention to provide a one-piece metal connector which is dimensioned to fit a particular standardized size of truss, which connector can be manufactured economically in quantity; which affords greater strength than wooden tension webs, and which because of its construction, provides great savings in fabrication and assembly.

It is another object of this invention to provide a connector of the type set forth which can be assembled to a wooden truss structure without the necessity of any special sawing operations and without the use of separate fasteners.

It is another object of this invention to provide a connector of the type set forth which facilitates accurate positioning on the truss to eliminate placement errors.

These and other objects of the invention are attained by providing a connector for interconnecting spaced-apart members of a wooden truss structure or the like, the connector comprising an elongated support member, two end plates respectively integral with the support member at the opposite ends thereof, and two groups of fastening members respectively integral with the end plates and extending therefrom substantially normal thereto in the same direction, the two groups of fastening members being adapted to be respectively embedded in two associated spaced-apart truss members for attachment thereto and to provide an interconnection therebetween.

Further features of the invention pertain to the particular arrangement of the parts of the connector whereby the above-outlined and additional operating features thereof are attained.

The invention, both as to its organization and method of operation, together with further objects and advantages thereof, will be best understood by reference to the following specification taken in connection with the accompanying drawings.

DESCRIPTION OF THE PREFERRED EMBODIMENT

Figures 1, 2, 3, 4, 5:
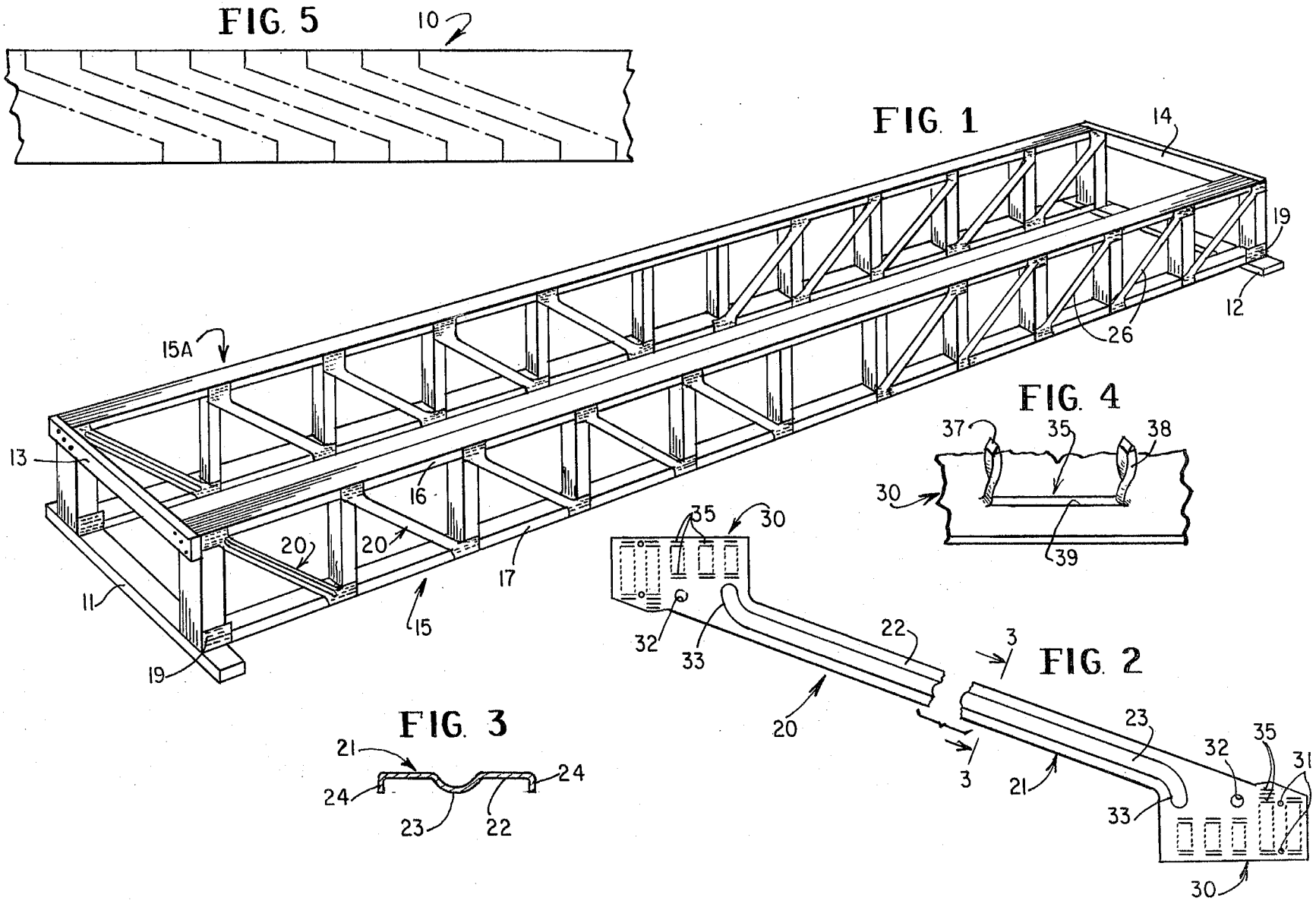
FIG. 1 is a perspective view of a double truss system utilizing a plurality of connectors constructed in accordance with and embodying the features of the present invention.
FIG. 2 is a front elevational view of one of the connectors of the present invention.
FIG. 3 is a cross sectional view taken along the line 3—3 in FIG. 2.
FIG. 4 is an enlarged fragmentary perspective view of a portion of one of the end plates of the connector of FIG. 2, viewed from the opposite side thereof, and illustrating the formation of the fastening members.
FIG. 5 is a fragmentary view illustrating in dashed lines a series of connectors on a sheet of steel prior to fabrication.

Referring to FIG. 1 of the drawings, there is illustrated a double floor truss system, generally designated by the numeral 10, which includes two elongated floor trusses 15 and 15A, which are spaced apart and arranged substantially parallel to each other. The bottoms of the trusses 15 and 15A are interconnected at the opposite ends thereof by wood bearing members 11 and 12, while the tops of the trusses 15 and 15A are interconnected at the opposite ends thereof by wood top cross members 13 and 14. The trusses 15 and 15A are substantially identical in construction, wherefore only the truss 15 will be described in detail.

The truss 15 includes an elongated wood top chord member 16 and an elongated wood bottom chord member 17, arranged parallel to each other and vertically spaced-apart by a plurality of longitudinally spaced vertical wood studs 18. The bottom chord 17 may be fastened to the studs 18 at the opposite ends thereof by corner plates 19.

The truss 15 also includes a plurality of diagonal tension web connectors 20 and 25 extending diagonally between adjacent ones of the studs 18 and between the top and bottom chords 16 and 17. The connectors 20 and 25 are respectively designed for use in the left-hand and right-hand halves of the truss 15, when viewed from the side to which the connectors 20 and 25 are applied. The connectors 20 and 25 are constructed as mirror images of each other, wherefore only the connector 20 will be described in detail.

Referring to FIGS. 2 through 4 of the drawings, the connector 20 is formed of metal, preferably steel, and is of a unitary one-piece construction. The connector 20 includes an elongated support arm 21 which has a flat plate 22 provided with a central stiffening rib 23 extending the length thereof. Formed along the lateral side edges of the main plate 22 and extending downwardly therefrom substantially normal thereto in the same direction as the rib 23 are two edge flanges 24, which also serve to stiffen the support arm 21.

Respectively integral with the support arm 21 at the opposite ends thereof are two end plates, each generally designated by the numeral 30, and being substantially identical in construction. Each of the end plates 30 is generally rectangular in shape and is oriented so that the longitudinal axis of the support arm 21 extends generally diagonally across the end plate 30. The end plates 30 are substantially coplanar, and each is provided with a pair of small-diameter index holes 31 and a relatively large-diameter index hole 32, the holes 31 and 32 being adapted for receiving therein locating pins or the like for facilitating location of the connector, both in fabrication thereof and in assembly thereof to the truss 15. The central rib 23 of the support arm 21 extends a slight distance into each of the end plates 30 and terminates thereat in a curved end portion 33. The edge flanges 24 terminate at the end plates 30 so as not to interfere with the attachment of the end plates 30 to the truss 15, as will be described more fully below and those flanges 24 also serve to position the connector relative to at least one of the wood members.

Each of the end plates 30 is provided with a plurality of rows of aligned, spaced-apart stampings, each generally designated by the numeral 35. Referring in particular to FIG. 4, each of the stampings 35 comprises two fastening brads or nails 37 and 38 which are struck from the end plate 30, leaving therebetween an oval slot 39. The stamping is such that each of the fastening brads 37 and 38 is pointed and is slightly twisted about its axis to facilitate embedment in and attachment of the connector to the wooden truss 15.

In use, the connector 20 is positioned so as to extend diagonally upwardly to the left from the bottom chord 17 to the top chord 16 between two adjacent ones of the vertical studs 18, as shown in FIG. 1. The connector 20 is dimensioned so as to fit a particular size truss, with the upper end plate 30 overlapping the adjacent portions of the top chord 16 and one stud 18, while the lower end plate 30 overlaps adjacent portions of the bottom chord 17 and another stud 18, with the fastening brads 37 and 38 disposed toward the truss 15. The brads 37 and 38 are then embedded in the overlapped portions of the top and bottom chords 16 and 17 and the vertical studs 18 by the use of a suitable tool such as a mallet or the like. When the fastening brads 37 and 38 are thus embedded, the connector 20 is securely attached to the truss 15 and forms a tension web thereof.

It will be noted that in order to optimize the attachment area of the end plates 30 and to maximize the number of fastening brads 37 and 38 available for embedment in the truss 15, the portions of the end plates 30 which overlap the vertical studs 18 are provided with slightly longer rows of stampings 35 than on the other portions of the end plates 30, so as to provide attachment points along the vertical studs 18 below the top chord 16 and above the bottom chord 17.

It will be appreciated that a connector 20 is preferably applied between each adjacent pair of vertical studs 18 in the left-hand half of the truss 15 and, similarly, a right-hand connector 25 is applied between each adjacent pair of the vertical studs 18 in the right-hand half of the truss 15. The connectors 20 and 25 may be factory-installed as part of a prefabrication process, or may be installed in the field in the case of on-site framing of the trusses 15 and 15A. Because no special saw cuts need to be made for the installation of the connectors 20 and 25, and because no separate fasteners are utilized, the speed of construction of the trusses 15 and 15A is greatly enhanced and the cost thereof is substantially reduced. Additionally, it will be understood that the assembly of the connectors 20 and 25 on a truss entails considerably less skill than is required for the fabrication and assembly of wood tension webs, or for a three part or coupled metal connector. While the connectors 20 and 25 of the present invention have been disclosed as tension webs for use in floor trusses, it will be understood that they could be used in other types of trusses and could be used to form other structural components for use in bracing, scabbing, bridging and the like.

In a constructional model of the present invention, the truss 15 is a floor truss with a bottom chord bearing having an overall length of 20 feet, 4 inches, wherein each of the top and bottom chords 16 and 17 and the vertical studs 18 is formed of 2×4 wood members. The truss 15 has a 12 inch depth with 24 inch stud spacing. The connector 20 is formed of 20 gauge steel, each end plate comprising a rectangle about 5.1 inches by 2.2 inches. Each of the end plates 30 is provided with 37 pairs of the fastening brads 37 and 38, arranged in three rows of six pairs each, one row of ten pairs and one row of nine pairs, each of the fastening brads 37 and 38 being approximately ⅜ inch long and ⅛ inch wide. The support arm 21 has a width of about 1.3 inches, with the edge flanges 24 having a depth of about 0.25 inch. The small index holes 31 have a diameter of about 9/64 inch, while the large index holes 32 have a diameter of about ½ inch.

It will be appreciated that the connectors 20 and 25 can be made in different sizes and of different gauge metal for use with different size trusses of for different structural applications, the above-recited dimensions being merely illustrative.

The shape of the connector 20 also facilitates its construction with a minimal waste. Thus, in FIG. 5 (40) there is illustrated a section of steel band on which shown, in dashed lines, a layout of a plurality of connectors to be formed from the band 40.

From the foregoing, it can be seen that there has been provided an improved structural connector for wooden trusses or the like, the connector being formed of metal and of unitary one-piece construction, and being capable of assembly to the truss without the use of special tools, without the need for any special saw cuts, without the use of any separate fasteners, and which can be fabricated with minimum waste of materials.

While there has been described what is at present considered to be the preferred embodiment of the invention, it will be understood that various modifications could be made therein, and it is intended to cover in the appended claims all such modifications as fall within the true spirit and scope of the invention.

What is claimed is:

1. A unitary metal connector for interconnecting spaced-apart chord members of a wooden truss structure, wherein said truss structure includes a plurality of wooden studs extending between the parallel spaced-apart chord members, said connector comprising an elongated generally rectangular support member having a central stiffening rib extending longitudinally thereof and side flanges formed thereon and extending therefrom substantially normal thereto along the side edges of said rectangular support member, said connector further including two end plates respectively integrally formed with said support member at the opposite ends thereof, each of said end plates being generally rectangular in shape and coplanar with said support member and being oriented with respect to said support member so that the longitudinal axis of said support member extends generally diagonally of said end plates; each of said end plates having fastening means integrally formed therewith consisting of a plurality of rows of aligned barbs struck from the associated end plate and extending therefrom substantially normal thereto and in the same direction, said barbs being configurated and arranged such that said fastening members are adapted to be respectively embedded in the two associated spaced-apart wooden truss members and into opposite ends of spaced wooden studs extending therebetween, for attachment thereto and to provide a strengthening interconnection therebetween.

2. In combination with a wooden truss structure, including upper and lower parallel chords interconnected by longitudinally spaced-apart vertical studs, a unitary metal connector comprising an elongated generally rectangular support member extending diagonally between the upper and lower chords and between two adjacent ones of the studs, said support member having a centrally disposed strengthening rib, and having side flanges formed thereon and extending therefrom substantially normal thereto along the side edges thereof, said connector further including two generally rectangular end plates respectively integrally formed with said support member at the opposite ends thereof and dimensioned and arranged so that said plates are coplanar with said support member and are oriented with respect to said support member so that the longitudinal axis of said support member extends generally diagonally of said end plates, said end plates also being arranged so that one end plate overlaps the upper chord and the upper end portion of one stud and the other end plate overlaps the lower chord and the lower end portion of the other stud, each of said end plates having fastening means integrally formed therewith, said fastening means consisting of a plurality of rows of aligned barbs struck from the associated end plate and extending therefrom substantially normal thereto and in the same direction, said fastening means being adapted to be embedded in the overlapped portions of the associated chords and studs for attachment thereto and to provide an interconnection therebetween.

* * * * *